United States Patent [19]

Wielang et al.

[11] 3,943,062

[45] Mar. 9, 1976

[54] CRYOLITE PROCESS FOR THE SOLIDIFICATION OF RADIOACTIVE WASTES

[75] Inventors: Joseph A. Wielang, Idaho Falls, Idaho; Larry L. Taylor, Fort Belvoir, Va.

[73] Assignee: The United States of America as represented by the United States Energy Research and Development Administration, Washington, D.C.

[22] Filed: May 13, 1974

[21] Appl. No.: 469,736

[52] U.S. Cl. ..... 252/301.1 W
[51] Int. Cl.[2] ..... G21F 9/16
[58] Field of Search ..... 252/301.1 W

[56] References Cited

FOREIGN PATENTS OR APPLICATIONS 837,967 6/1960 United Kingdom ..... 252/301.1 W

OTHER PUBLICATIONS

ICP–1008 Newby, B. J. et al., "DTA–X–Ray Diffraction Examination . . . Potassium Nitrates".

*Primary Examiner*—Leland A. Sebastian
*Assistant Examiner*—Deborah L. Kyle
*Attorney, Agent, or Firm*—Dean E. Carlson; Arthur A. Churm; Robert J. Fisher

[57] ABSTRACT

An improved method is provided for solidifying liquid wastes containing significant quantities of sodium or sodium compounds by calcining in a fluidized-bed calciner. The formation of sodium nitrate which will cause agglomeration of the fluidized-bed particles is retarded by adding aluminum and a fluoride to the waste in order to produce cryolite during calcination. The off-gas of the calciner is scrubbed with a solution containing aluminum in order to complex any fluoride which may be liberated by subsequent dissolution of cryolite and prevent corrosion in the off-gas cleanup system.

6 Claims, No Drawings

CRYOLITE PROCESS FOR THE SOLIDIFICATION OF RADIOACTIVE WASTES

CONTRACTUAL ORIGIN OF THE INVENTION

The invention described herein was made in the course of, or under, a contract with the UNITED STATES ATOMIC ENERGY COMMISSION.

BACKGROUND OF THE INVENTION

This invention relates to a method for solidifying liquid radioactive wastes for long-term storage as a solid. The invention further relates to solidifying the liquid waste by calcining in a fluidized-bed calciner. The invention is specifically directed towards the fluidized-bed calcination of liquid radioactive waste containing significant quantities of sodium or sodium compounds.

In the chemical reprocessing of spent nuclear reactor fuel elements to recover the unburned nuclear reactor fuel material, very large volumes of aqueous solutions containing radioactive wastes are generated. In addition to the large volumes produced, these aqueous waste solutions are extremely corrosive and present difficult problems in their handling and storage. Since it is necessary to store these radioactive wastes for extremely long periods of time to permit decay of the highly radioactive fission products included in the wastes, the aqueous wastes are converted to a solid form which, in addition to occupying less volume than the corresponding liquid wastes, is less corrosive and imposes less difficult problems in handling and long-term storage. These aqueous radioactive waste solutions are converted to a solid form by calcining in a fluidized bed in the Waste Calcining Facility at the Idaho Chemical Processing Plant located at the United States Atomic Energy Commission's National Reactor Testing Station in southeastern Idaho. The aqueous solutions are converted to solid form by calcining in a fluidized bed, the aqueous solutions being injected into the fluidized bed through spray nozzles mounted in the walls.

A particular problem is posed in the fluidized-bed calcination of liquid radioactive wastes which contain significant quantities of sodium or sodium compounds. Since a considerable concentration of nitrates will necessarily be present due to the use of acids including nitric acid to dissolve the spent nuclear reactor fuel elements, sodium nitrate can be formed. Sodium nitrate will melt and exist in a molten state between 305°C. and 833°C. Therefore, at the normal calcination temperatures (400°–500°C.), sodium nitrate could result in agglomeration of the bed particles and consequent fouling of the fluidized bed. Since agglomeration of the fluidized-bed particles is intolerable, it is desirable to eliminate or minimize the presence of molten sodium nitrate during calcination.

It is an object of the present invention to provide a method for the fluidized-bed calcination of sodium-containing liquid radioactive wastes which will not result in agglomeration of the fluidized-bed particles.

It is a further object of the present invention to provide a method for preventing agglomeration of the fluidized bed by retarding and minimizing the formation of sodium nitrate.

SUMMARY OF THE INVENTION

In accordance with the present invention, aluminum and a fluoride are added to the liquid radioactive wastes prior to their introduction into the fluidized-bed calciner. Cryolite is formed in the fluidized-bed calciner by reaction of the aluminum and fluoride with any sodium nitrate which may be present. The sodium is tied up in the cryolite, thereby minimizing the amount of sodium nitrate present in the calciner and preventing agglomeration of the bed particles due to the presence of molten sodium nitrate. Aluminum is added to the scrub solution for scrubbing the off-gases of the calciner. Fluoride volatility, and hence corrosion in the off-gas cleanup system, is thereby prevented by complexing with the aluminum any fluoride which may be released by dissolution of any of the cryolite.

DESCRIPTION OF THE INVENTION

In the practice of the present invention, aluminum and a fluoride are added to liquid radioactive wastes containing significant quantities of sodium or sodium compounds, which wastes are to be solidified for long-term storage as a solid by calcining the wastes in a fluidized-bed calciner. The aluminum and fluoride are added to the liquid wastes prior to the spraying of the wastes in the calciner. Preferably, the aluminum and fluoride are added to the wastes in the form of solid $AlF_3$ compounds or in the form of hydrofluoric acid and aluminum metal, although addition of the aluminum and fluoride in other forms is also possible. In the fluidized bed the sodium in the wastes combines with the aluminum-fluoride to produce cryolite ($Na_3AlF_6$ or $3NaF, AlF_3$). Fluoride addition displaces the nitrate during the calcination process while the aluminum complexes the fluoride in the aqueous phase. The reaction for the main reactants can be expressed:

$$3Na^+ + Al^{+3} + 6F^- \rightarrow Na_3AlF_6$$

The more complete reaction can be written:

$$6NaNO_3 + 4AlF_3 \rightarrow 2Na_3AlF_6 + Al_2O_3 + 6NO_2 + 3/2\,O_2$$

The cryolite formation during calcining allows the sodium waste to be solidified to hard granular particles without fluid-bed agglomeration.

Since significant quantities of fluoride will be present and fluoride volatility will result in very undesirable corrosion problems, it is preferred that aluminum and sodium be present in excess over that required for cryolite formation. An excess of about 10% is believed to be sufficient to eliminate any possibility of fluoride volatilization in the fluidized bed. When excess aluminum and sodium are contained in the solutions introduced into the fluidized bed, the excess aluminum will be converted to aluminum oxide, while the sodium will form sodium nitrate. Therefore, the amount of excess must be kept sufficiently low such that the amount of sodium nitrate formed remains sufficiently small that it does not pose a problem with bed agglomeration. An excess of about 10% has been found to cause no problems with bed agglomeration and is therefore preferred.

The addition of fluoride and the formation of cryolite, which is a fluoride-containing compound, raise other considerations which must be taken into account in devising a satisfactory process for solidifying these wastes. The off-gases of the calciner must be freed of undesirable pollutants in the off-gas cleanup system, and routinely are scrubbed in order to remove any particulate matter which may be given off from the calciner. It is likely, and preliminary studies have shown, that some cryolite will be contained in the off-gases of the calciner and will be dissolved downstream in the off-gas scrub solution. When the cryolite dissolves in the scrub solution, fluoride could volatilize and cause corrosion problems in the off-gas cleanup system. Therefore, aluminum is added to the scrub solution in the off-gas cleanup system in order to complex any fluoride released from cryolite dissolution, thereby preventing fluoride volatility. While the aluminum could be added to this solution in many forms, it has been found that aluminum nitrate is a convenient form in which to introduce the $Al^{+3}$ ion. The aluminum nitrate is added in amounts sufficient to complex any fluoride released from dissolution of the cryolite. Consequently, corrosion problems from fluoride volatility are eliminated.

The embodiments of the invention in which an exclusive property or privilege is claimed are defined as follows:

1. In the method of solidifying liquid radioactive wastes for long-term storage as a solid by calcining said liquid radioactive wastes in a fluidized-bed calciner wherein said liquid radioactive wastes contain significant quantities of sodium or sodium compounds, the improvement therein comprising: adding aluminum and a fluoride to said wastes in a form which will yield aluminum and fluoride ions and in an amount so as to produce cryolite during said calcination of said sodium-containing wastes and scrubbing the off-gas of said calciner with a solution to which aluminum has been added.

2. The method in accordance with claim 1 wherein the aluminum and fluoride are added to said wastes in quantities such that aluminum and sodium are present in excess over that required for cryolite formation.

3. The method of claim 2 wherein said excess is about 10%.

4. The method of claim 2 wherein the aluminum and fluoride are added to said wastes in the form of solid $AlF_3$ or in the form of hydrofluoric acid and aluminum metal.

5. The method in accordance with claim 1 wherein said aluminum is added to said scrubbing solution in the form of aluminum nitrate.

6. The method in accordance with claim 5 wherein said aluminum nitrate is added to said scrubbing solution to a concentration sufficient to complex any fluoride released from dissolution of the cryolite.

* * * * *